US005590766A

United States Patent [19]

Carnahan et al.

[11] Patent Number: 5,590,766

[45] Date of Patent: Jan. 7, 1997

[54] TRANSPARENT SHOE BOX

[76] Inventors: Garnett Carnahan; Caroline Carnahan; Marvin R. Carnahan, all of Rte. 3, Box 18, Nixa, Mo. 65714

[21] Appl. No.: 392,174

[22] Filed: Feb. 22, 1995

[51] Int. Cl.[6] ..... B65D 85/18

[52] U.S. Cl. ..... 206/296; 206/292

[58] Field of Search ..... 206/471, 278, 206/292, 296

[56] References Cited

U.S. PATENT DOCUMENTS

| | | | |
|---|---|---|---|
| 1,781,624 | 11/1930 | Barnes | 206/292 X |
| 2,333,643 | 11/1943 | Donnellan | 206/278 X |
| 3,063,550 | 11/1962 | Boden et al. | 206/296 |
| 3,414,093 | 12/1968 | Chostner | 206/292 X |
| 4,083,483 | 4/1978 | Bayless | 206/278 X |
| 4,795,029 | 1/1989 | Campbell et al. | 206/471 X |

FOREIGN PATENT DOCUMENTS

| | | | |
|---|---|---|---|
| 904396 | 11/1945 | France | 206/296 |
| 586558 | 10/1933 | Germany | 206/296 |

*Primary Examiner*—Allan N. Shoap

*Assistant Examiner*—Christopher J. McDonald

*Attorney, Agent, or Firm*—Beveridge, Degrandi, Weilacher & Young, LLP

[57] ABSTRACT

A transparent shoe box has a box body proper and a box cover. All box bodies and box covers are made of transparent plastic. At the edge of one side, the box body and the box cover are joined together, forming a connecting overlapping edge. In a preferable design, along the center-line of the bottom of the box body and the box cover, there is one or more cylindrical protruding members. In addition, there are two shoe-holders corresponding basically to the size of the feet of the shoe users. Each of the shoe-holders includes a shoe-prop and a protruding or raised part. At the end surface of the protruding or raised part there is a polygonal recess. The shoe-holders can, by dint of the recess on the protruding or raised part, be inlaid and firmly mounted on the protruding member located on the bottom of the box proper or on the box cover. Furthermore, each shoe is placed tidily and apart from each other at a certain position specified by the type of box. This provides trimness in arrangement and view worthiness, as well as maintains free circulation of air between shoes, reducing the phenomena of crumpling and mildewing.

15 Claims, 2 Drawing Sheets

TRANSPARENT SHOE BOX

Figure 1:
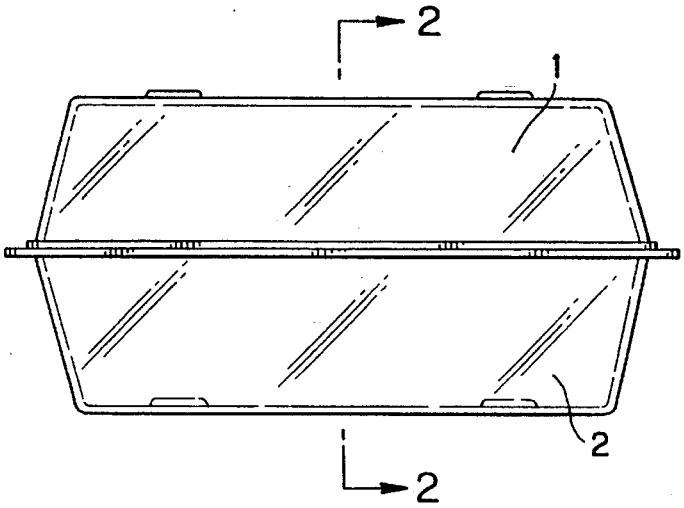

This utility model relates to a kind of footgear-housing shoe box, bearing upon in particular a transparent shoe box with which the shoes stored inside could be directly seen through.

Generally, shoe boxes used to store shoes for selling in the market include leather shoe boxes, sandal shoe boxes, cloth shoe boxes, sneaker shoe boxes, or rubbers shoe boxes. Currently manufacturers are using paper stuffed, paper or cardboard boxes. Some of these said boxes are made very elaborately and the shoes stored therein are marked according to their styles and sizes. Looking from the outside, one cannot directly see the shoes stored to determine their style. As a result of using the above mentioned shoe boxes to store shoes particularly by individuals or families once they are purchased, when a certain pair of shoes are desired to be worn it is usually necessary for each box to be opened one by one to obtain the desired pair. This is by no means a convenience for the consumer. In addition the shoes contained in the boxes are typically arranged in such a fashion that the upper part of the shoes contact each other. Apart from being unsightly, the insteps of the shoes are liable to be gravely crumpled. Also when two shoes are laid visa vis, there is almost no space for the air to circulate, it will thus promote the shoe to retain moisture and mildew. This problem is impossible to eliminate if not discovered in time and will irrevocably damage the surface of the shoes.

The object of the present utility model is aimed at the defects of the said shoe-boxes, with a view to remedy them and present a kind of transparent shoe-box allowing the sizes, styles, and colors of shoes to be kept in boxes enabling them to be seen directly and both shoes to be placed independently.

With the said object in view, this new transparent shoe-box consists of a box body proper and a box cover that has several design options. All box bodies and box covers made of a transparent plastic. At the edge of one side the box body and the box cover, are joined together, forming a connecting overlapping edge.

In another design, along the center-line of the bottom of the box body and the box cover, there is one or more cylindrical protruding member spaced apart equidistantly, in addition there are two shoe-holders corresponding basically to the size of the feet of shoe users. Each of the said shoe-holders are comprised of the following: a shoe-prop in the form of a shoe tree, and a protruding or raised part which forms integrally with the shoe-prop and which is located upon it. At the end surface of the said protruding or raised part there is a polygonal recess. The shoe-holders can, by dint of the recess on the protruding or raised part, be inlaid and firmly mounted on the protruding member located on the bottom of the box proper or on the box cover.

In another design, the said protruding member is located respectively at such positions as on the middle point of the lengthwise central line of the bottom of the box body and the box cover, or the right and/or left side equidistant from the said middle point of the same.

In still another design, the said protruding member, in plenarily and/or specially (three dimensional) and diagonally symmetrical manner, is located at such positions as equidistant from the upper side and/or lower side of the length wise central line of the bottom of the box body or box cover and equidistant from the left side and/or right side of the longitudinal axis of the said bottom of the box body and/or box cover, besides, such equidistance from the upper side and/or the lower side of the lengthwise central line of the bottom of the shoe box body and/or shoe box cover may be larger or smaller than the equidistance from the left side and/or the right side of the said longitudinal axis.

In the present utility mode, both shoe box proper and shoe box cover are made of transparent plastics by one blowing or molding, the said shoe-holder is also made of transparent plastic by one blowing or molding. Thus it can be seen from the prior information that due to the fact that the new type transparent shoe-boxes are made of transparent plastics, man can see to determine size, style and color of the shoes within the shoe box. Furthermore, each shoe is placed tidily and apart from each other at a certain position specified by the type of box. This can not only ease retrieval by the salesman and wearers, but also owns trimness in arrangement and view worthiness, as well as maintaining free circulation of air between shoes, reducing the phenomena of crumpling and mildewing. Moreover, it owns reasonable structure, facilitates the manufacturer and allows for adopting production lines to mass produce automatically and considerably enhance labor productivity.

FIG. 1—Shows the front view of the first embodiment of the transparent box according to the present utility model.

Figure 2:
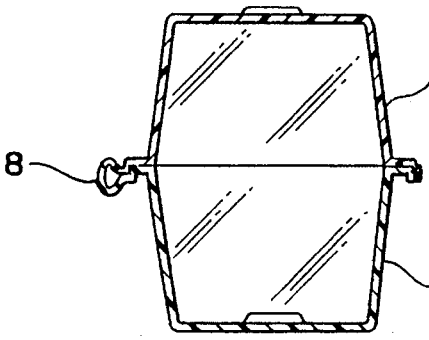

FIG. 2—Shows the directional view made along line A—A of FIG. 1.

Figure 3:
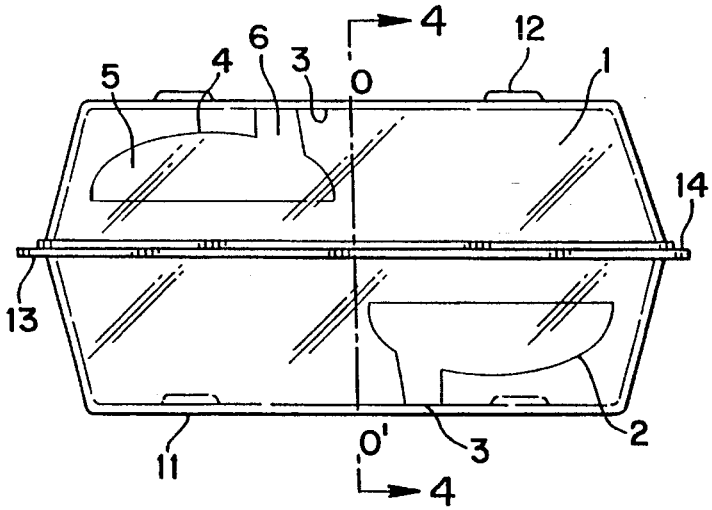

FIG. 3—Shows the front view of shoe-holder for the transparent box of the second embodiment of the present utility model.

Figure 4:
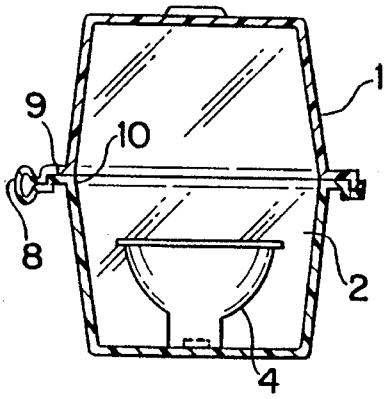

FIG. 4—Shows the sectional view made along line C—C of FIG. 3.

Figure 5:
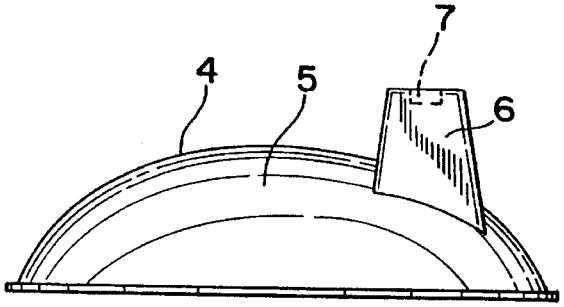

FIG. 5—Shows the front view of shoe holders in transparent box according to the present utility model.

Figure 6:
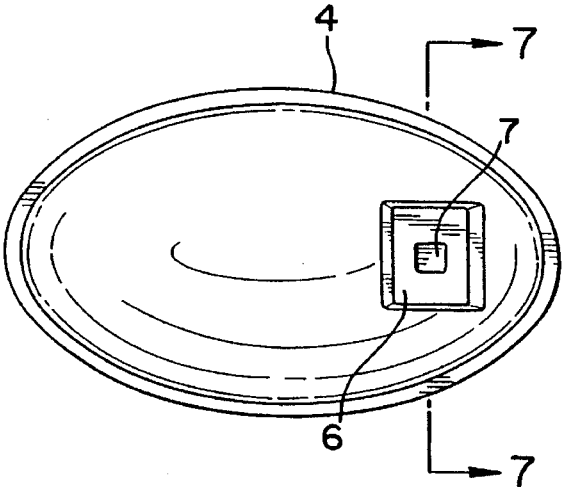

FIG. 6—Shows the view of FIG. 5.

Figure 7:
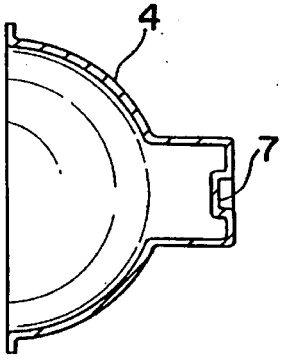

FIG. 7—Shows the sections view made cling line BB of FIG. 6.

Please refer to FIGS. 1 and 2. This new type transparent shoe box consists of a box body proper 1 and a box cover 2. They are made of transparent plastics, such as polyvinyl chloride, by blowing or molding. The edges of one side of box body proper and box cover are joined to form overlapping edge 8.

In another embodiment of the present utility model, in the bottom of the shoe box body (1) and that of the shoe box cover (2) is respectively defined one or evenly distributed protruding members (3). The said protruding members may be located wither at the middle position of the central lines 00 and/or 0'0' of the bottom of the shoe box body (1) and/or shoe box cover (2). Furthermore the transparent shoe-box contains in addition two shoe tree like shoe holders (4). Each shoe holder (4) of the transparent shoe box consists of a foot form shoe prop and protruding or raised part (6) protruding from the shoe holder body. At the end surface of the protruding or raised part (6), there is a recess (7), which is optionally polygonal, teragonal, hexagonal or octagonal. In this instance it is tetragonal. In other designs, other forms may be adopted, for example a saw tooth form. But disregarding whatever shape or form, generally the distance between the opposite sides of the polygon of the polygon of the polygonal recess (7) must be smaller than the cylindrical external diameter of protruding members (3), three inches on the box body proper (1) and box cover (2).

In the third embodiment of the present utility model, the number and the structure of the protruding member (3) and the shoe holder member (4) are identical to the above-mentioned embodiments. As to the positions of the protruding members (3), they may be respectively located on the right side and the left side of the middle point of the central lines 00 and 0'0' of the bottom of the shoe box body and/or shoe box cover, alternatively, may be located on the left side or right side equidistant from the middle point of the bottom of the shoe box body (1) and/or shoe box cover (2) as shown in FIG. 3 and FIG. 4.

In the fourth embodiment of the present utility model, the number and the structure of the protruding member (3) and the shoe holder (4) are basically identical to the above-mentioned embodiments. As to the positions of the protruding members, the said protruding members (3) are located respectively in plenarily or specially (three-dimensional) diagonal symmetrical manner, at the intersecting position of the upper side and the lower side equidistant from the lengthwise central line 00 of the bottom of the shoe box body and/or shoe box cover and the left side and the right side equidistant from the longitudinal 00. That is to say, the intersecting point may be located either on upper left/lower right or lower left/upper right side of the four quadrants formed by the central line 00 and the intersecting point equidistant from the longitudinal axis 00 may be either equal or the former may be larger or smaller than the latter.

In reference to the other optional structures of shoe boxes, according to the prerequisites of the users or the needs of production and uses, shoe boxes with body (1) and cover (2) may be made in separate or joint state. The height of box body proper (1) and box cover (2) may be made different or the same. In this embodiment the box body proper and box cover were made in joint state. One side of the said box body and that of the said box cover are integrally joined and form a joint overlapping side (8), what is more, box body proper (1) and box cover (2) have the same height. In closing and fastening box cover (2) and box body proper (1), this is accomplished by various shapes of concave/convex engaging mechanisms. For example, on this embodiment, on the edge of box cover (2) there is a concave groove (9), at the rim of the box body proper (1) and box cover (2), concave/convex parts 11,12, or verges 13, 14 may be provided. The holders may also have peripheral edge on the verge of foot prop to raise its strength.

In the uses of the said shoe boxes according to the present utility model, we may insert the shoe prop into the shoe opening, making its bottom part to contact basically with the bottom of shoes, then, the holder with the shoe on, by means of the recess on its protruding or raised part to fit on the protruding member of the shoe box body and box cover of the shoe box. Due to the vertical distance of the opposite sides of the recess is lesser than the cylindrical external diameter of the protruding member, the recess brings forth elastic deformation and makes the holders closely fixed on the cylindrical protruding member. The joint manner and bonding force of the recess with protruding member are enough to ensure the holders with shoes on will not fall off when being hung on box cover or box body proper.

We claim:

1. A transparent shoe box comprising:

a box body made of a transparent plastic;

a box cover made of a transparent plastic, wherein a first edge of the box body and a first edge of the box cover are integrally connected together;

a first shoe holder attached to the box body, wherein the first shoe holder is positionable inside a shoe to hold the shoe; and a second shoe holder attached to the box cover, wherein the second shoe holder is positionable inside a shoe to hold the shoe, and wherein the first shoe holder includes a shoe prop part, and a protruding part extending from the shoe prop part, and wherein a polygonal recess is defined at an end surface of the protruding part of the first shoe holder.

2. A transparent shoe box as in claim 1, wherein the second shoe holder includes a shoe prop part, and a protruding part extending from the shoe prop part.

3. A transparent shoe box as in claim 2, wherein a polygonal recess is defined at an end surface of the protruding part of the second shoe holder.

4. A transparent shoe box as in claim 3, wherein the box cover includes a protruding member which fits into the polygonal recess of the second shoe holder.

5. A transparent shoe box as in claim 3, wherein the box body includes a protruding member which fits into the polygonal recess of the first shoe holder.

6. A transparent shoe box as in claim 1, wherein the box body includes a protruding member which fits into the polygonal recess of the first shoe holder.

7. A transparent shoe box as in claim 1, wherein the box body and the box cover are the same height.

8. A transparent shoe box as in claim 1, wherein the box body includes a first protruding member, and the first shoe holder is attached to the box body at the first protruding member.

9. A transparent shoe box as in claim 8, wherein the box cover includes a second protruding member, and the second shoe holder is attached-to the box cover at the second protruding member.

10. A transparent shoe box as in claim 1, wherein the box cover includes a protruding member, and the second shoe holder is attached to the box cover at the protruding member.

11. A transparent shoe box comprising:

a box body made of a transparent plastic;

a box cover made of a transparent plastic, wherein a first edge of the box body and a first edge of the box cover are integrally connected together;

a first shoe holder attached to the box body, wherein the first shoe holder is positionable inside a shoe to hold the shoe; and a second shoe holder attached to the box cover, wherein the second shoe holder is positionable inside a shoe to hold the shoe, and wherein the first shoe holder includes a first shoe prop part, and a first protruding part extending from the first shoe prop part, and wherein the second shoe holder includes a second shoe prop part, and a second protruding part extending from the second shoe prop part, and wherein a first recess is defined at an end surface of the first protruding part of the first shoe holder, and wherein a second recess is defined at an end surface of the second protruding part of the second shoe holder.

12. A transparent shoe box as in claim 11, wherein the box body includes a first protruding member which fits into the first recess of the first shoe holder, and wherein the box cover includes a second protruding member which fits into the second recess of the second shoe holder.

13. A transparent shoe box as in claim 12, wherein the box body and the box cover are the same height.

14. A transparent shoe box as in claim 12, wherein a first distance between opposite sides of the first recess is smaller than an outer diameter of the first protruding member, and wherein a second distance between opposite sides of the second recess is smaller than an outer diameter of the second protruding member.

15. A transparent shoe box, comprising:

a box body made of a transparent plastic;

a box cover made of a transparent plastic engaged with the box body;

a first shoe holder attached to the box body, wherein the first shoe holder is positionable inside a shoe to hold the shoe; and a second shoe holder attached to the box cover, wherein the second shoe holder is positionable inside a shoe to hold the shoe, and wherein the first shoe holder is attached to the box body by way of a dint connection between a protruding member and an outwardly elastically deformable recess which are formed in the protruding part of said first shoe holder and in said box body, and wherein the second shoe holder is attached to the box cover by way of a dint connection between a protruding member and an outwardly elastically deformable recess which are formed in the protruding part of said second shoe holder and in said box cover.

* * * * *